US008758177B2

(12) United States Patent
Minica

(10) Patent No.: US 8,758,177 B2
(45) Date of Patent: Jun. 24, 2014

(54) DEVICE AND METHOD FOR ILLUMINATING AN ARROW NOCK

(76) Inventor: Stuart Minica, La Vernia, TX (US)

( * ) Notice: Subject to any disclaimer, the term of this patent is extended or adjusted under 35 U.S.C. 154(b) by 0 days.

(21) Appl. No.: 13/101,137

(22) Filed: May 4, 2011

(65) Prior Publication Data

US 2012/0100942 A1 Apr. 26, 2012

Related U.S. Application Data

(60) Provisional application No. 61/406,999, filed on Oct. 26, 2010.

(51) Int. Cl.
*F42B 6/06* (2006.01)

(52) U.S. Cl.
USPC ..... 473/586; 473/570

(58) Field of Classification Search
USPC ..... 473/570, 578, 585, 586
See application file for complete search history.

(56) References Cited

U.S. PATENT DOCUMENTS

| | | | | |
|---|---|---|---|---|
| 2,484,589 | A | 10/1949 | Richards | |
| 2,887,319 | A | 5/1959 | Lay | |
| 4,003,576 | A | 1/1977 | Carella | |
| 4,305,588 | A | 12/1981 | Dodge | |
| 4,340,930 | A * | 7/1982 | Carissimi | 362/204 |
| D301,272 | S | 5/1989 | Barrow et al. | |
| 4,856,792 | A | 8/1989 | Hardison | |
| 5,134,552 | A * | 7/1992 | Call et al. | 362/203 |
| 5,154,432 | A | 10/1992 | Saunders | |
| 5,306,020 | A | 4/1994 | Bolf | |
| 6,123,631 | A | 9/2000 | Ginder | |
| 6,364,499 | B1 | 4/2002 | Jones | |
| 6,390,642 | B1 | 5/2002 | Simonton | |
| 6,695,727 | B1 | 2/2004 | Kuhn | |
| 6,736,742 | B2 | 5/2004 | Price et al. | |
| 7,021,784 | B2 | 4/2006 | DiCarlo | |
| 7,189,170 | B1 | 3/2007 | Korsa et al. | |
| 7,211,011 | B1 | 5/2007 | Sutherland | |
| 7,374,504 | B2 | 5/2008 | Palomaki et al. | |
| 7,837,580 | B2 * | 11/2010 | Huang et al. | 473/570 |
| 7,927,240 | B2 | 4/2011 | Lynch | |
| 7,931,550 | B2 | 4/2011 | Lynch | |
| 7,993,224 | B2 | 8/2011 | Brywig | |
| 2002/0039939 | A1 | 4/2002 | Hartman | |
| 2003/0166425 | A1 | 9/2003 | Sutherland et al. | |

OTHER PUBLICATIONS

Archery Talk—Archers Helping Archers Forum: "Homemade Stuff?", http://www.archerytalk.com/vb/showthread.php?t=201870& page=48&p=5786267 (2007).

(Continued)

*Primary Examiner* — John Ricci
(74) *Attorney, Agent, or Firm* — Covington & Burling LLP; Gregory S. Discher

(57) ABSTRACT

Devices and methods for illuminating an arrow nock or bolt end are disclosed including providing a nock having a first portion adapted to receive the bowstring in a drawn position and a second portion adapted to receive the bowstring after the bowstring is released from the drawn position; a light source assembly at least partially disposed within the nock body and activated when the bowstring is released from the drawn position; the light source assembly comprising a power source, a light source and a switch; and at least a portion of the light source assembly protruding from the end of the nock body so that releasing the bowstring causes the switch to close, thereby activating the light source and illuminating the nock or bolt end. Other embodiments are described and claimed.

23 Claims, 13 Drawing Sheets

(56) References Cited

OTHER PUBLICATIONS

Archery Talk—Archers Helping Archers Forum: "Homemade Stuff?", http://www.archerytalk.com/vb/showthread.php?t=201870& page=48&p=5791405 (2007).

Archery Talk—Archers Helping Archers Forum: "Homemade Stuff?", http://www.archerytalk.com/vb/showthread.php?t=201870& page=62&p=1056170361 (2009).

* cited by examiner

DEVICE AND METHOD FOR ILLUMINATING AN ARROW NOCK

CROSS REFERENCE TO RELATED APPLICATIONS

This application CLAIMS PRIORITY to U.S. Provisional Patent Application Ser. No. 61/406,999 filed on Oct. 26, 2010, which is incorporated herein by reference in its entirety.

FIELD OF THE INVENTION

The invention relates generally to the field of archery, specifically to arrow nocks and crossbow bolt ends, and still more specifically, to illuminated arrow nocks and bolt ends.

BACKGROUND

Various forms of lighted nocks, or crossbow bolt ends (as the functionally equivalent device is known when utilizing a crossbow) are known in the art, but all suffer from certain drawbacks. Although arrow nocks and crossbow bolt ends are distinguished in their general shape, both are collectively referred to herein as a "nock" for convenience of description.

A lighted arrow nock allows an archer to be able to more easily see the arrow in flight, see the point of arrow impact, and recover the arrow after a shot. Being able to observe the arrow in flight and see the point of impact helps the archer to diagnose problems with shooting form or bow setup and make appropriate adjustments. Perhaps more importantly, a lighted arrow nock allows an archer to more easily recover the arrow.

Bow hunters can especially benefit from using an arrow with a lighted nock device. Recovering an arrow that was shot at an animal is critical in the ethical harvest of animals, and a lighted nock device allows a bow hunter to recover the arrow and animal more easily. Upon recovering the arrow, the bow hunter can diagnose many things about the shot by inspecting the arrow. The presence of blood or other debris on the arrow, or lack thereof, gives many clues as to if the arrow impacted the animal in a desired vital area or not, or if the arrow even hit the animal at all.

Some previous lighted nock designs have utilized a chemical light source or have been composed of luminescence material, such as U.S. Pat. No. 4,856,792, issued Aug. 15, 1989 to Philip M. Hardison; U.S. Pat. No. 6,364,499, issued Apr. 2, 2002 to Thomas M. Jones; and U.S. Pat. No. 7,211,011 issued May 1, 2007 to Warren Sutherland. To activate the chemical light source, a vial or container must be broken to allow the mixing of chemicals to produce a light emitting chemical reaction. The nock or vial cannot be turned off and must be disposed of because it had to be broken to allow the chemicals to mix. The largest drawback to these designs is the amount of light emitted from these chemical sources is not bright enough to be effective. Additionally, these designs add weight and cost to the arrow but do not provide enough light to see the arrow in flight or to see the point of arrow impact. The Hardison and Sutherland devices require the vial to be broken before the bow is shot, either before the nock is assembled to the arrow or when the nock is placed onto the bowstring. A bow hunter needs to hunt prepared to release an arrow at an animal with little notice. To be prepared for a quick shot, the hunter should break these vials every time they hunt, but often bow hunters never get an opportunity to shoot while hunting so these broken vials go to waste. If the hunter tries to conserve the nock or vial by waiting to break the vial until they see an animal they want to shoot, then they risk alerting the animal with too much noise or movement or taking too much time installing it and thus losing the shot opportunity. Whichever method the hunter tried to activate, because they must be activated prior to the shot, it is possible for the animal to see the light coming from the device and spot the hunter before the hunter can draw and shoot the bow and arrow. The Jones device allows for breaking of the vial during the shot and not prior to the shot, but still suffers from not being able to be turned off when desired and the amount of light is not generally sufficient to see the arrow in flight, the point of arrow impact, or to assist in recovering the arrow.

Some lighted nock designs have embedded battery powered lamps or light emitting diodes (LEDs). For example, U.S. Pat. No. 6,123,631, issued on Sep. 26, 2000 to Jeffery Allen Ginder, utilizes a battery-powered light emitting diode (LED). This lighted nock device is always turned on unless it is nocked on the bowstring or unless a special cap is attached to the nock to turn off the LED. The switch used in the Ginder device is a non-latching switch that is always in the closed or "on" position and either the bowstring or the special cap opens the switch to turn off the LED. The cap can easily become lost and quickly drain the battery rendering the nock useless. The cap is extra weight to carry on the arrows in your quiver and extra hassle to worry about. When removing the cap, the switch will close and turn on the LED before it is ever mounted on the bow where the bowstring opens the switch and turns off the LED again. This may be acceptable for target archers, but for bow hunters this is not desirable as an animal could be alerted by the light coming from the device and spot the hunter. If a bow hunter needed to make a quick second shot he would have to remove the cap from his second arrow before being able to install the second arrow which would waste time. After the arrow is shot and the arrow strikes an animal or the ground, the LED could easily be turned off if animal tissue, leaves, or any other debris becomes lodged in the nock, thus opening the switch.

U.S. Pat. No. 6,390,642, issued on May 21, 2002 to Robert Wayne Simonton, also utilizes a battery powered LED and has a switch that is responsive to a magnetic field. This design requires a separate magnet to be attached to the bow which not only adds cost and weight, but the magnet can also be lost in the field rendering the lighted nock device useless. The system also requires a printed circuit board to house the electronics to sense the magnetic field and switch the LED on or off. The circuit must remain on which can drain the battery when not in use. The required electronics add unnecessary weight to the arrow and drive up the cost of the device.

U.S. Pat. No. 6,736,742, issued on May 18, 2004 to Curtis Lee Price and Ivan Eric Price, also uses a battery powered LED, but its switching mechanism requires critical contact with the arrow shaft to activate the LED which can lead to a lack of reliability. The nock of the Price device has two metal contact points that are forced into the rear of the arrow shaft during the release of the bow. The arrow shaft requires special preparation to ensure that metal contacts touch the shaft correctly, which is often done improperly or completely overlooked by archers resulting in unreliable activation. The Price device also requires the arrow to be electrically conductive and thus will not work with fiberglass, wood, or other non-conductive arrow materials. The largest drawback to the Price design is that often the lighted nock will turn off upon impact due to vibrations from the impact causing the metal contacts to lose contact with the rear of the arrow. Because the nock must slide in and out to turn on and off, respectively, the nock and the arrow wear on each other and become loose over time, compounding the problem of the device turning off inadvertently during impact. As the metal contacts are repeatedly forced into the arrow shaft, the arrow shaft is gouged by the metal contacts, creating a problem for the critical electrical contact between the metal contacts and the arrow shaft.

U.S. Pat. No. 7,021,784, issued Apr. 4, 2006 to Joseph L. DiCarlo, is another lighted nock device which uses battery powered LEDs. This device also requires the nock to slide back and forth in the arrow against a special backstop, which must be installed in the arrow before the lighted nock device can be used. The archer must glue the backstop into the rear of his arrow at a precise depth or the LED will not activate correctly. The backstop and the glue add unnecessary weight to the arrow. Because the nock must slide in and out of the arrow to be turned on and to be turned off, respectively, the nock and the arrow wear on each other and become loose over time.

What is needed is an illuminated arrow nock that will turn on upon release of a bowstring, is more dependable, and does not require any extra parts, assembly, or preparation work by the archer.

SUMMARY

In contrast to the above-described conventional approaches, embodiments of the invention are directed to an illuminated nock assembly that helps an archer see an arrow during flight, see the point of arrow impact, and recover the arrow. Furthermore, the present invention allows for a more robust and reliable nock that saves weight and reduces cost relative to prior art lighted nock designs.

Embodiments of the present invention are equally applicable to arrow nocks used with conventional longbows and recurve and compound bows, as well as to bolt ends used with crossbows and crossbow bolts.

One embodiment of the invention is directed to a nock device comprising: a nock body adapted to receive a bowstring in a first portion thereof and a second portion thereof when the bowstring is released, and a light source assembly comprising a power source, a light source (such as an LED), and a switch, wherein at least a portion of the light source assembly protrudes from the nock body and contacts the bowstring when the bowstring moves into the second portion on release of the bowstring.

In another aspect, a method for illuminating a nock is disclosed, the method comprising: providing nock body adapted to receive a bowstring in a first portion thereof and a second portion thereof when the bowstring is released, and a light source assembly comprising a power source, a light source (such as an LED), and a switch; drawing the bowstring; and releasing the bowstring to force the switch to a closed position, thereby illuminating the nock.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

Figure 1:
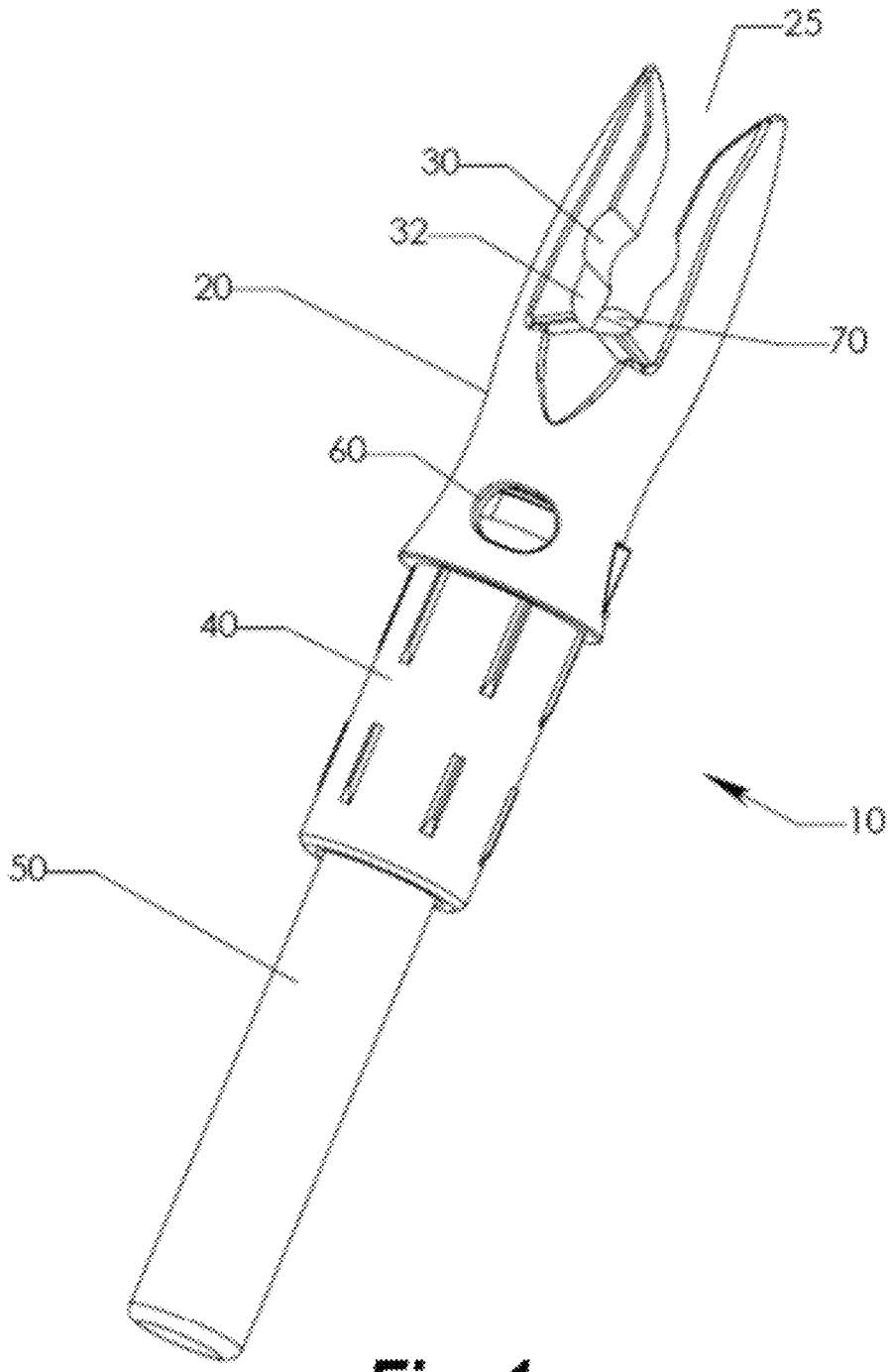
FIG. 1 is a side perspective of a lighted nock device, in accordance with some embodiments.

While the invention is subject to various modifications and alternative forms, specific embodiments thereof are shown by way of example in the drawings and the accompanying detailed description. It should be understood, however, that the drawings and detailed description are not intended to limit the invention to the particular embodiments. This disclosure is instead intended to cover all modifications, equivalents, and alternatives falling within the scope of the present invention as defined by the appended claims.

DETAILED DESCRIPTION

One or more embodiments of the invention are described below. It should be noted that these and any other embodiments are exemplary and are intended to be illustrative of the invention rather than limiting.

The invention relates to the field of archery and the problem of being able to see an arrow in flight, being able to see the point of arrow impact, and most importantly, finding an arrow after the shot. More specifically, this invention relates to an illuminated arrow nock assembly that helps an archer see an arrow during flight, see the point of arrow impact, and recover an arrow with an improved design which is not only more dependable but also saves weight and reduces cost.

FIGS. 1-4 illustrate one embodiment of a lighted nock device of the present invention weighing less than 30 grains from various perspectives. FIG. 1 shows a side perspective of the lighted nock device 10 comprising nock body 20 having a slot 25 and a first portion 30 for attaching a bowstring, a second portion 32 where the bowstring moves to after the archer releases the bowstring, an arrow attachment portion 40 (which centers the nock within the arrow shaft by conventional means), a reset aperture 60, a slide switch 70 located at least partially within nock body 20, and a power source 50. A light source assembly (described in further detail with respect to FIG. 4) comprises the power source 50, the slide switch 70, and a light source such as an LED (not shown).

In some exemplary embodiments, power source 50 is a tubular dry cell battery, such as (but not limited to) a common alkaline, zinc-air, lithium ion, or other small cell currently known or in use today.

In some embodiments, nock body 20, first portion or attachment portion 30, second portion or activation portion 32, and arrow attachment portion 40 are formed of a monolithic piece of rigid material, such as (but not limited to) plastic, polycarbonate, compounds thereof and the like, all of which are well known in the art for their suitability for arrow nock material. Alternatively, nock body 20 may be formed from one or more pieces of rigid material and then joined together via conventional means. Such forming and/or joining may be accomplished through any methods known in the art for producing plastic materials. Accordingly, the method of making the nock body is not further discussed herein.

The principles of this improved lighted nock are equally applicable to all forms of transparent or translucent materials. In addition, opaque materials may also be used when slots, holes, or other apertures are provided to allow the light to escape. Accordingly, the present invention is not limited to any type of material or fabrication method for producing the device.

In some embodiments, the light source assembly may form an integrated package. Various other sources of these components, and alternate arrangements are possible. Although separate power source, light source, and switch are described, those skilled in the art will realize that integrated assemblies of some or all of these components may also be used. Accordingly, the concepts, apparatus, and techniques described herein are not limited to any particular packaging of these components.

Figure 2:
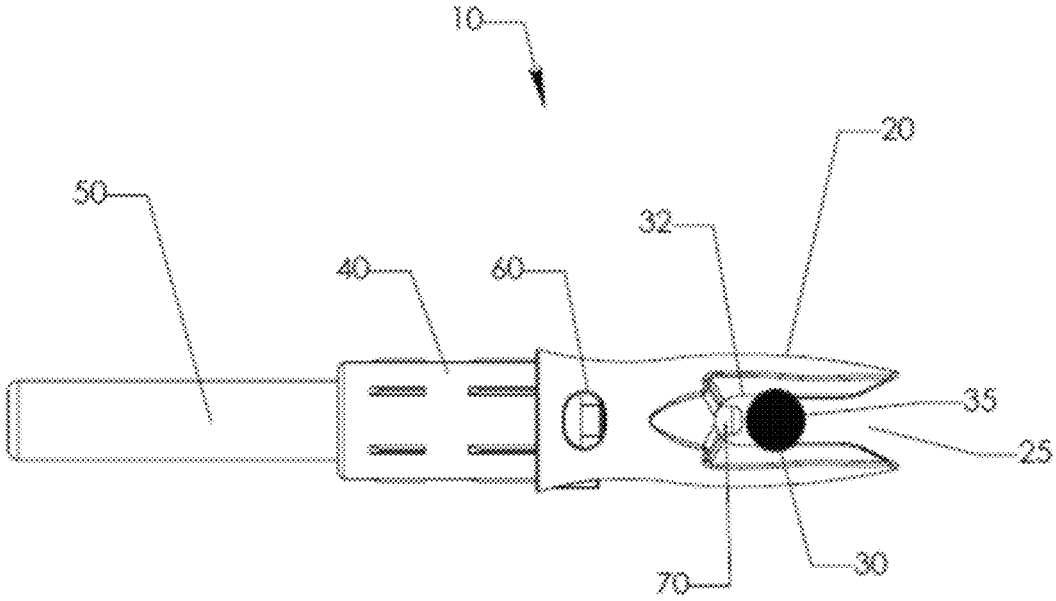
FIG. 2 is a top perspective of the lighted nock device in the "Off" state, in accordance with some embodiments.
Figure 3:
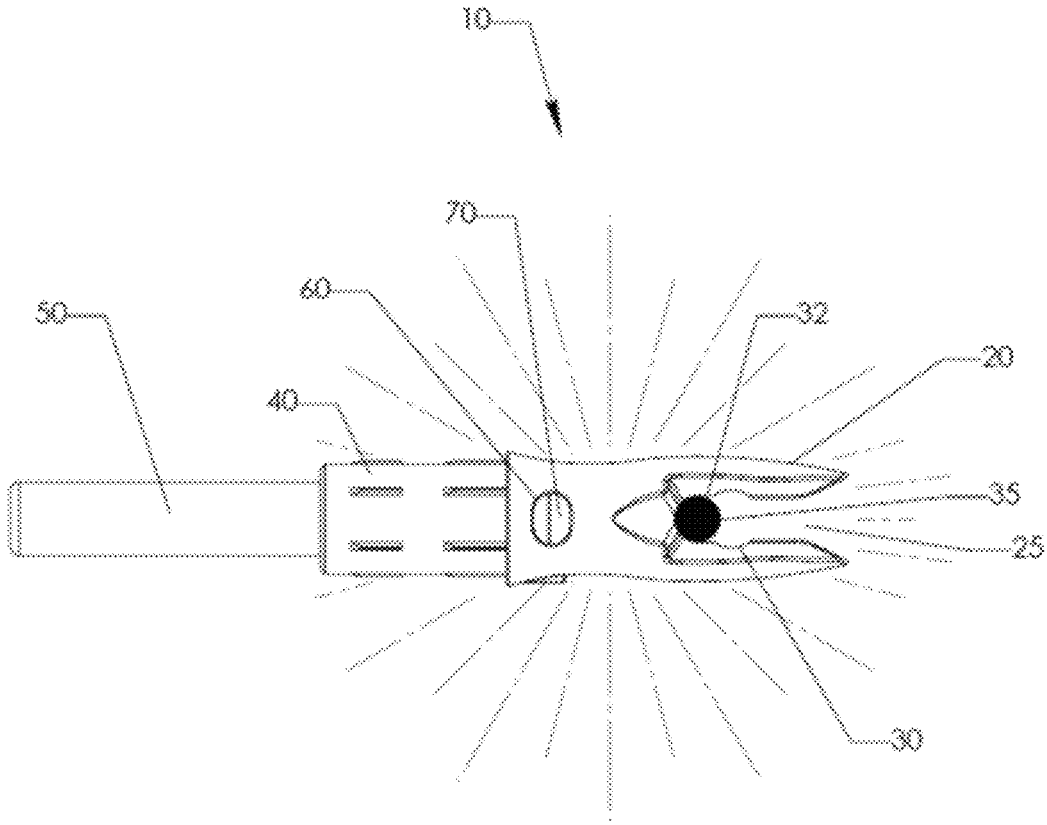
FIG. 3 is a top perspective of the lighted nock device in the "On" state, in accordance with some embodiments.

FIG. 2 shows a top perspective of the lighted nock device 10 with the light source turned off comprising nock body 20 having a slot 25 with bowstring 35 located in first portion or attachment portion 30. Switch 70 is shown in the open position (light source turned off). A portion of the switch 70 passes through an aperture in the nock body 20, into the bottom of slot 25, and extends into the region of nock body 20 defined by second portion or activation portion 32. The bowstring 35 is held within first portion 30 near the switch 70. When the archer releases the bowstring, the bowstring will move from where it is initially attached, first portion 30, into the second portion 32 of slot 25. At the second portion 32, the bowstring 35 activates the light source assembly by making contact with the switch 70 to slide switch 70 toward arrow attachment portion 40, closing the electrical contact between the power source 50, and turning the light source on as illustrated in FIG. 3. The archer can now see the light emitted from the lighted nock device allowing the archer to see the arrow during flight, see the point of arrow impact, and more easily find the arrow.

In an alternate embodiment, the light source assembly can be reversed or arranged in a different order so that a component other than the switch makes contact with the bowstring upon release. For example, but not by way of limitation, a portion of the LED could protrude into the second portion, thus resulting in the motion of the bowstring forcing the LED to close the switch. Furthermore, all or parts of the light source assembly may be located anywhere within the arrow shaft or the nock body, as long as the movement of the released bowstring causes the switch to close.

FIG. 3 shows a top perspective of the lighted nock device 10 with the light source turned on. Here, bowstring 35 is illustrated as being in the second portion 32 of slot 25 on bowstring release, just prior to the arrow leaving the bowstring. In this configuration, switch 70 is in the closed position.

Figure 4:
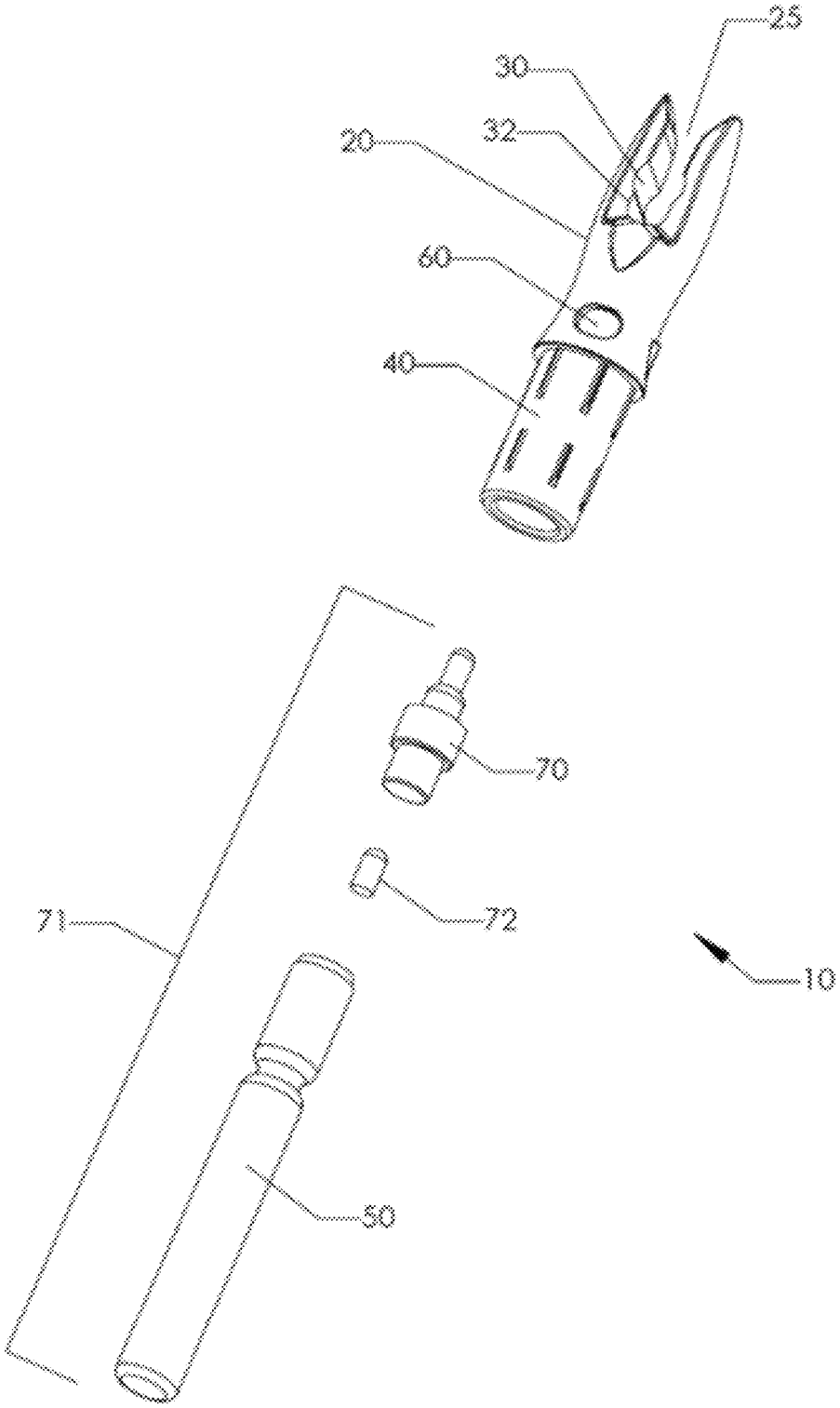
FIG. 4 is an exploded side perspective of the lighted nock device, in accordance with some embodiments.

FIG. 4 shows an exploded side perspective of the lighted nock device 10, comprising nock body 20, slot 25, first portion 30, second portion 32, arrow attachment portion 40, reset aperture 60, and a light source assembly 71 comprising a power source 50, a switch 70, and a light source 72 such as an LED. As described above, when fully assembled and in the open position (light source turned off), a portion of the switch 70 protrudes through an aperture in the nock body 20 and into the second portion 32, as shown in FIG. 2.

Although the functionality of light source 72 may, in some exemplary embodiments, be provided by a light emitting diode (LED), those skilled in the art will realize that light sources other than LEDs may also be used. Accordingly, the concepts, systems, and techniques described herein are not limited to any particular type of light source.

In the embodiment illustrated in FIGS. 1-4, switch 70 may comprise a slide switch configured to slide toward arrow attachment portion 40 when the bowstring is released, thereby closing the electrical circuit between the light source 72 and the power source 50. The slide switch 70 may be maintained in the closed position with the light source on until the archer desires to turn it off. To turn off the lighted nock device, in one exemplary embodiment, the archer may reach into the reset aperture 60 with a slender tool to reverse switch 70, thereby opening the switch contacts and turning off the light. In such embodiments, the archer may then reuse the lighted nock device 10.

In an alternate embodiment of the lighted nock device shown in FIGS. 1-4, the lighted nock device may omit reset aperture 60. In one such embodiment, the lighted nock device cannot be turned off once it has been illuminated. The light source will remain illuminated until the power source is electrically drained. This could be useful for an inexpensive, disposable lighted nock.

In yet another alternate embodiment of the lighted nock device shown in FIGS. 1-4, the lighted nock device may comprise two reset apertures 60. In this embodiment, the lighted nock device can be turned off from either of the apertures and would have a further reduction of weight.

In other embodiments, the lighted nock device may comprise a mechanically-maintained type of switch, also known as a latching, push button, or push on-push off switch, where the switch is depressed into the nock to turn on the light source and depressed again to turn off the light source. These mechanically-maintained type switches operate similarly to a ballpoint pen click action or a push on/off cabinet latch. The switch may be depressed by the force of the bowstring making contact with the switch after the bowstring is released. With this type switch, the light source remains on until the switch is depressed again to move the switch back to the open position. In these embodiments, the switch may be depressed by making contact with a bowstring or any other device or tool that fits in the bowstring-receiving slot. In such an embodiment, a reset aperture is not required to turn the light source off In a further alternate embodiment, the lighted nock device may comprise an electronically-maintained (or electronic) switch as an alternative to a mechanically-maintained/mechanical switch. In such a device, the bowstring would make contact with a momentary type switch configured to send a signal to an electrical circuit configured to receive the input and to toggle the light source on and off. The electronic switch may further comprise a piezoelectric element that generates an electrical impulse that is sent to the electronic circuit configured to receive the input to toggle the light source on and off. In such an embodiment, a reset aperture is not required to turn the light source off.

Figure 5:
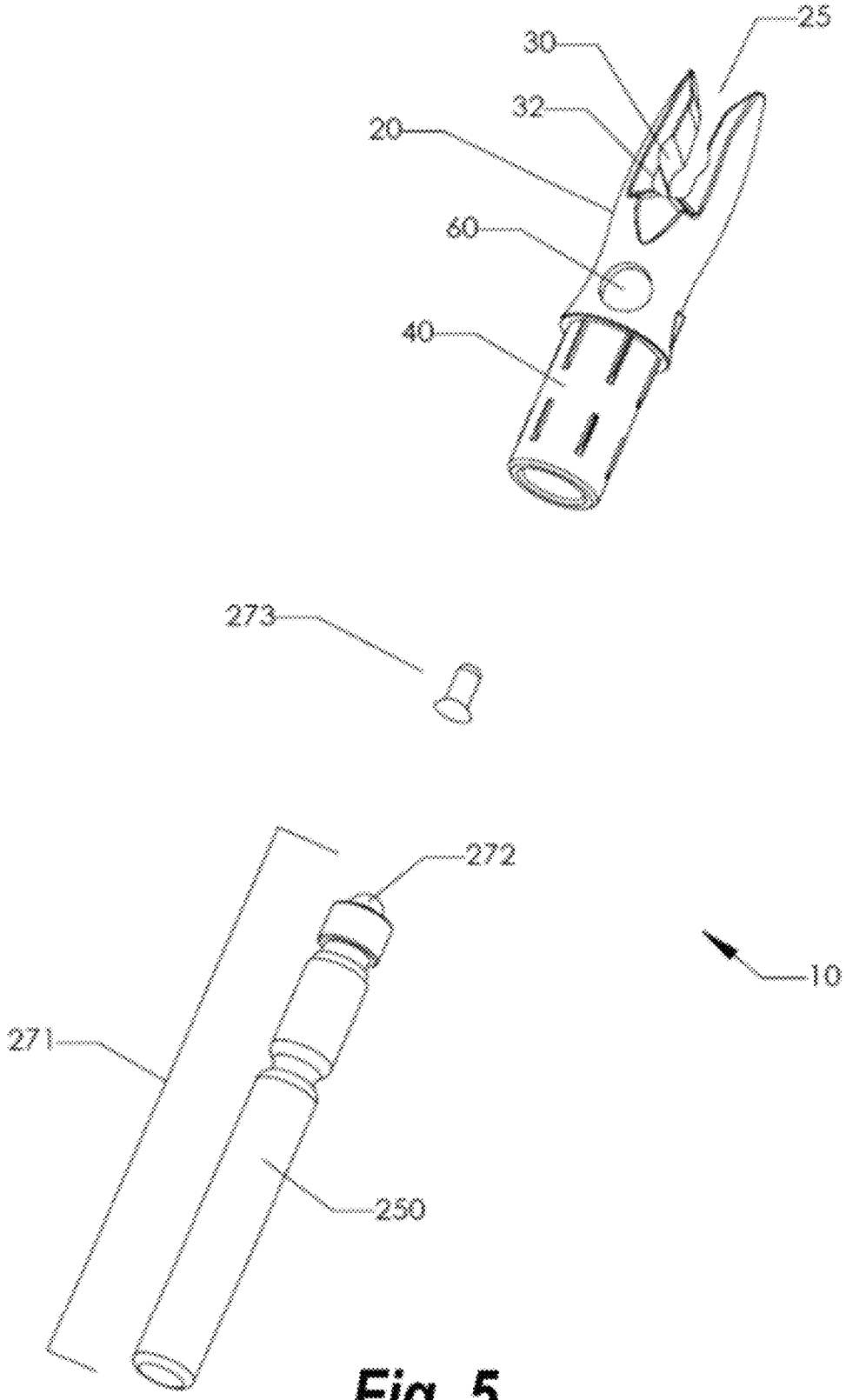
FIG. 5 is an exploded side perspective of a lighted nock device, in accordance with some embodiments.

FIG. 5 shows an exploded side perspective of the lighted nock device 10, in an alternate embodiment, comprising nock body 20, slot 25, first portion 30, second portion 32, arrow attachment portion 40, reset aperture 60, push rod 273, and a commercially available light source assembly 271 partially disposed within the nock body 20. The commercially available light source assembly 271 comprises a battery 250, an LED 272, and an internal single pole switch (not shown) sold as a combined unit. In this embodiment, when fully assembled and in the open position (LED turned off), a portion of the push rod 273 protrudes through an aperture in the nock body and into the second portion 32. When the archer releases the bowstring, the bowstring will move from where it is initially attached, first portion 30, into the second portion 32 of slot 25. At the second portion 32, the bowstring makes contact with the push rod 273 resulting in the pushing of the LED 272 toward the battery 250 which closes the internal single pole switch thus illuminating the LED 272. The archer can now see the light emitted from the lighted nock device allowing the archer to see the arrow during flight, see the point of arrow impact, and more easily find the arrow.

Figure 6:
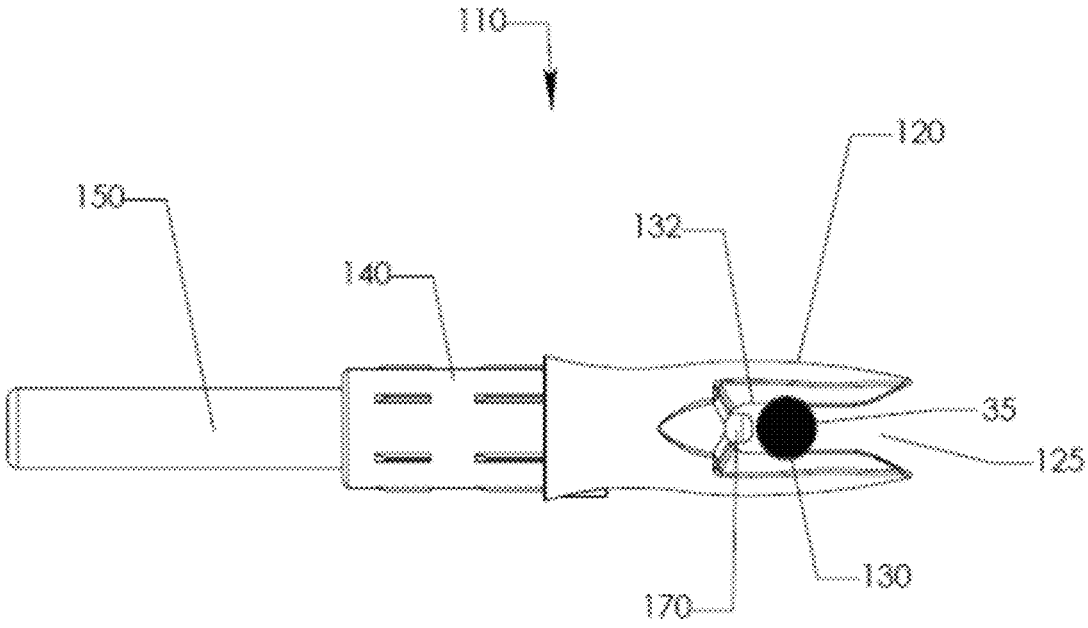
FIG. 6 is a top perspective of a lighted nock device in the "Off" state, in accordance with some embodiments.
Figure 7:
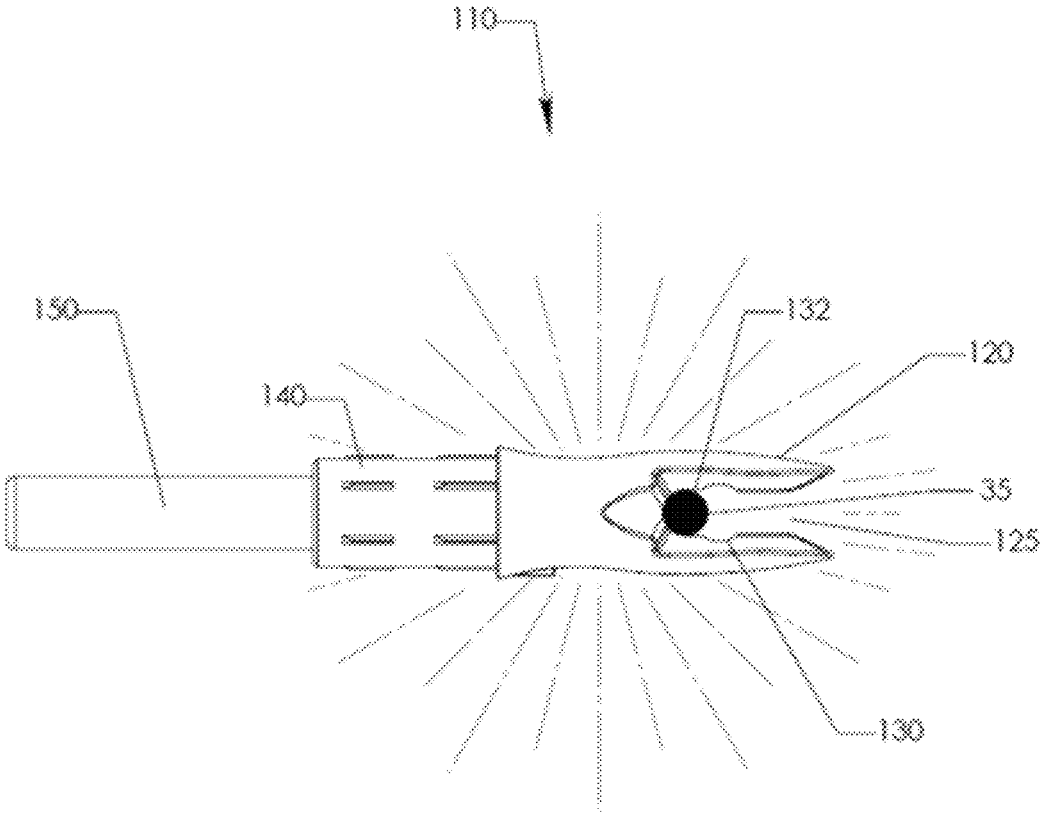
FIG. 7 is a top perspective of the lighted nock device in the "On" state, in accordance with some embodiments.

FIGS. 6 and 7 illustrate one embodiment of a lighted nock device with a mechanically-maintained (latching or push on-push off) switch instead of a slide switch as shown in FIGS. 1-4. FIG. 6 shows a top perspective of the lighted nock device 110 with the light source turned off comprising a nock body 120 having a slot 125 with a first portion 130 for attaching a bowstring 35, an arrow attachment portion 140, a power source 150, a light source (not shown), and a push on-push off switch 170 in the open position (light source turned off). A portion of the switch 170 passes through an aperture in nock body 120, into slot 125, and extends into a region defined by a second portion or activation portion 132. The bowstring 35 is held within first portion 130 near the switch 170. When the archer releases the bowstring, the bowstring will move from where it is initially attached, first portion 130, into the second portion 132 of slot 125. At the second portion 132, the bowstring 35 activates the light source by making contact with the switch 170 to slide switch 170 toward arrow attachment portion 140, closing the electrical contact between the power source 150, and turning the light source on as illustrated in FIG. 7. The archer can now see the light emitted from the lighted nock device allowing the archer to see the arrow during flight, see the point of arrow impact, and more easily find the arrow.

FIG. 7 shows a top perspective of the lighted nock device 110 with the light source turned on comprising nock body 120, slot 125, first portion 130, second portion 132, arrow attachment portion 140, a power source 150, a light source (not shown), and a push on-push off switch 170 (not visible) in the closed position. After the archer releases the bowstring, switch 170 is temporarily depressed into nock body 120 as bowstring 35 moves into second portion 132. As nock 110 leaves bowstring 35, a portion of the switch 170 returns into second portion 132 while the light source remains on.

In such embodiments, in order to turn off the lighted nock device, the archer may push switch 170 again with any slender tool which fits inside the slot 125 so the switch contacts open and the light source is turned off. The archer may now reuse the lighted nock device 110. In such an embodiment, a reset aperture is not required in nock body 120 to turn the light source off.

In an alternate embodiment of the lighted nock device illustrated in FIGS. 6 and 7, the lighted nock device may comprise an electronically-maintained (or electronic) switch as an alternative to a mechanically-maintained/mechanical switch. In such a device, the bowstring would make contact with a momentary type switch configured to send a signal to an electrical circuit configured to receive the input and to toggle the light source on and off. The electronic switch may further comprise a piezoelectric element that generates an electrical impulse that is sent to the electronic circuit configured to receive the input to toggle the light source on and off. In such an embodiment, a reset aperture is not required to turn the light source off.

Figure 8:
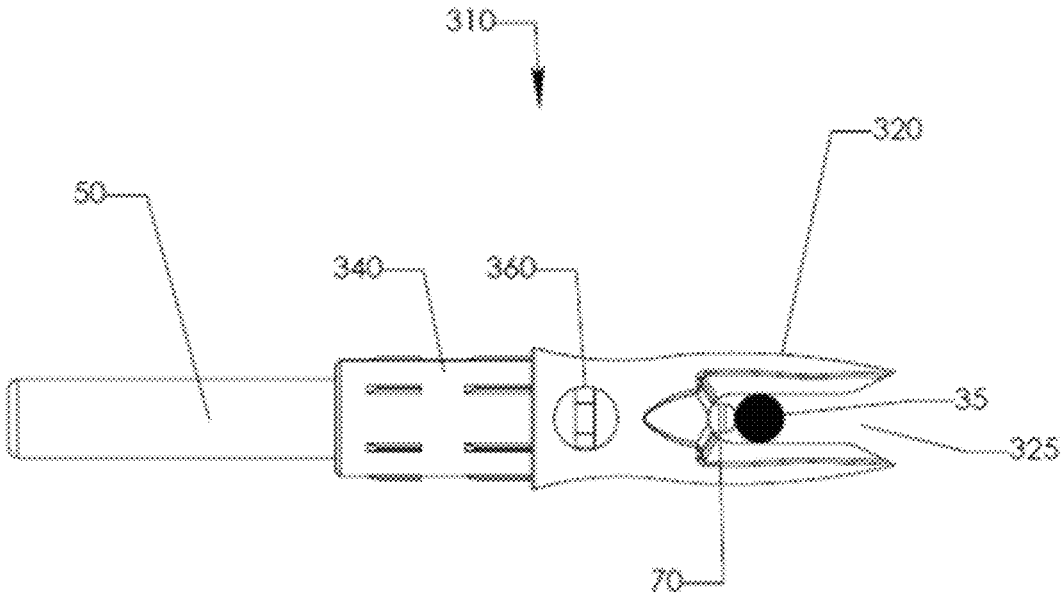
FIG. 8 is a top perspective of a lighted nock device in the "Off" state, in accordance with some embodiments.
Figure 9:
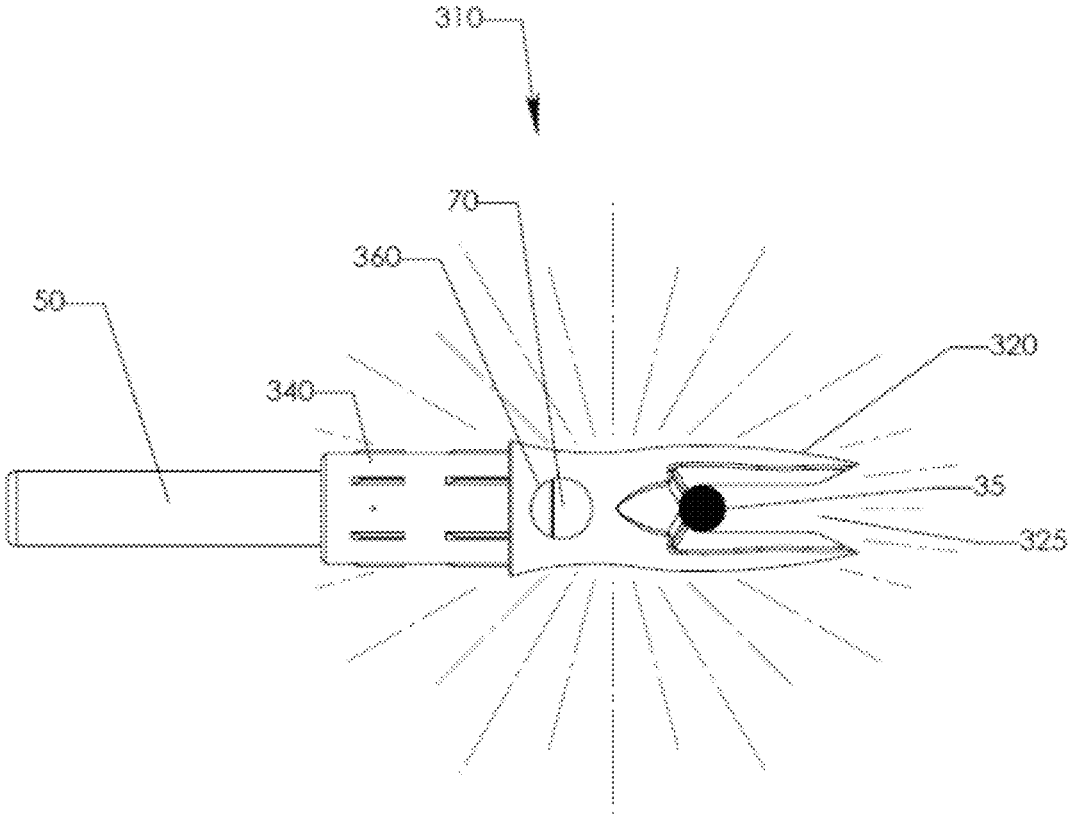
FIG. 9 is a top perspective of the lighted nock device in the "On" state, in accordance with some embodiments.

FIGS. 8 and 9 illustrate one embodiment of a lighted nock device comprising a nock body with a slot as in a typical arrow nock instead the nock body of FIGS. 1-7 with a first portion and a second portion. FIG. 8 shows a top perspective of the lighted nock device 310 with the light source turned off comprising a nock body 320 having a slot 325 for attaching a bowstring 35, an arrow attachment portion 340, a power source 50, a light source (not shown), and switch 70 in the open position (light source turned off). A portion of the switch or push rod 70 passes through an aperture in nock body 320, into slot 325. The bowstring 35 is held within first the slot by friction of the nock body on the bowstring, with the bowstring 35 touching the switch or push rod 70. The switch 70 may have extra spring or other resistance to resist turning on when the bowstring 35 initially touches it. When the archer releases the bowstring, the bowstring 35 will move deeper into slot 325 where the bowstring 35 activates the light source by making contact with the switch or push rod 70 to slide switch or push rod 70 toward arrow attachment portion 340, closing the electrical contact between the power source 50, and turning the light source on as illustrated in FIG. 9. The archer can now see the light emitted from the lighted nock device allowing the archer to see the arrow during flight, see the point of arrow impact, and more easily find the arrow.

FIG. 9 shows a top perspective of the lighted nock device 310 with the light source turned on comprising nock body 320, slot 325, arrow attachment portion 340, a power source 50, a light source (not shown), and a switch 70 in the closed position (light source turned on). Here, bowstring 35 is illustrated as being in the bottom of slot 325 on bowstring release, just prior to the arrow leaving the bowstring. In this configuration, switch 70 is in the closed position.

Figure 10:
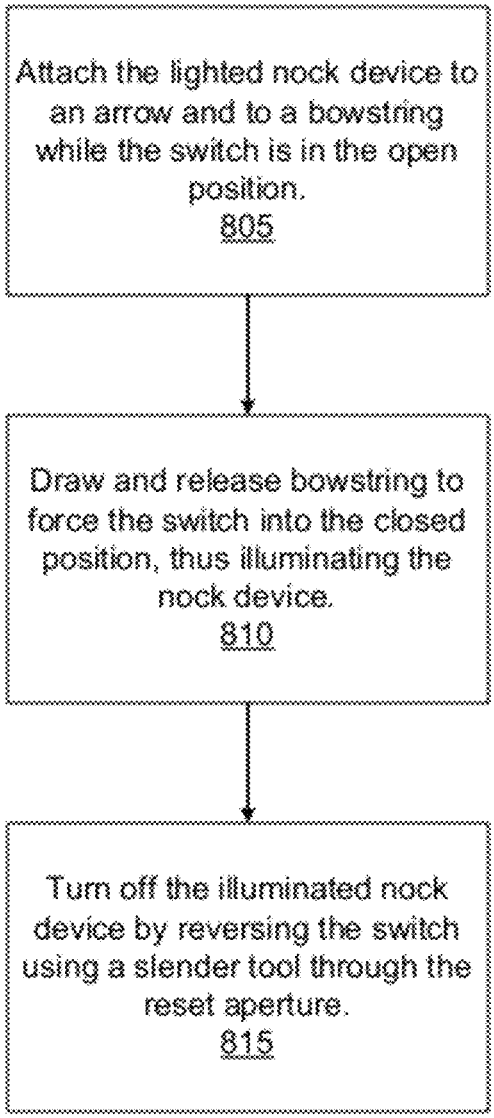
FIG. 10 is a flowchart illustrating a method for using a lighted nock device, in accordance with some embodiments.

A method for using the lighted nock device, according to one embodiment of the present invention, is illustrated in the flowchart of FIG. 10. The method begins at block 805, where the lighted nock device is attached to an arrow and to a bowstring while the switch is in the open position (light source turned off). At block 810, the bow is drawn and the bowstring is released, resulting in the force of the bowstring pushing on the switch and forcing the switch into the closed position (light source turned on), thus illuminating the nock device. The archer can now see the light emitted from the lighted nock device allowing the archer to see the arrow during flight, see the point of arrow impact, and more easily find the arrow. The switch is maintained in the closed position (light source turned on) until the archer desires to turn off the light source. After the arrow has been recovered, at block 815, the lighted nock device may be turned off by reaching into the reset aperture with a slender tool and reversing the switch until the switch contacts are open (light source turned off). The archer can now reuse the lighted nock device. A similar method may be applied to embodiments of the invention in a lighted bolt end device as described below.

Figure 11:
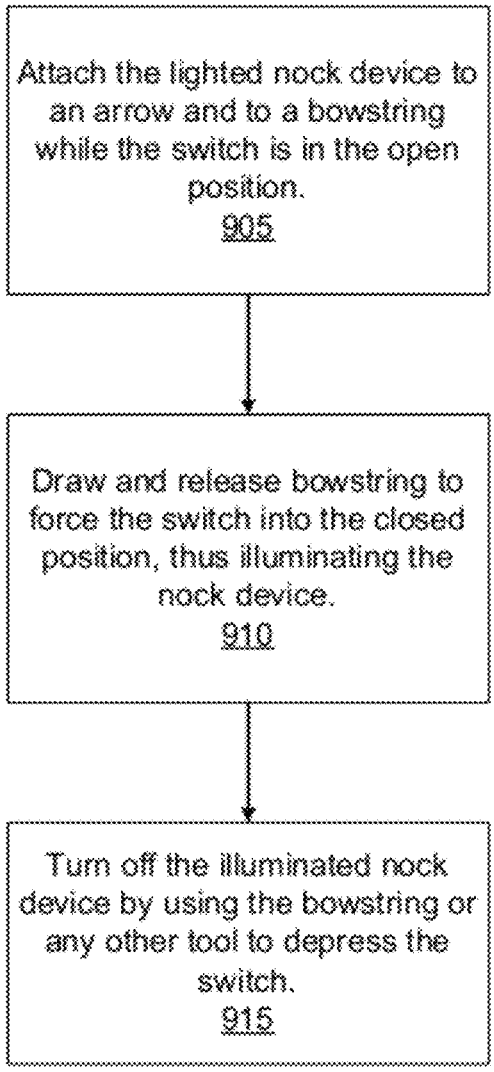
FIG. 11 is a flowchart illustrating a method for using a lighted nock device, in accordance with some embodiments.

Alternatively, a lighted nock device may be used as illustrated in the flowchart of FIG. 11. The method begins at block 905, where the lighted nock device is attached to an arrow and to a bowstring while the switch is in the open position (light source turned off). At block 910, the bow is drawn and the bowstring is released, resulting in the force of the bowstring pushing on the switch, thereby momentarily forcing the switch into the closed position (light source turned on), thus illuminating the nock device. The archer can now see the light emitted from the lighted nock device allowing the archer to see the arrow during flight, see the point of arrow impact, and more easily find the arrow. The light source remains on until the archer desires to turn it off. After the arrow has been recovered, at block 915, the lighted nock device may be turned off by using the bowstring or any other device or tool that fits within the arrow nock to depress the switch. The archer can now reuse the lighted nock device. A similar method may be applied to embodiments of the invention in a lighted bolt end device as described below.

In some embodiments, the lighted nock device may be configured for use on a crossbow. Arrows used on crossbows are known as bolts and nocks used on bolts are known as bolt ends. Such "bolt end nocks" (as that term is used herein) generally differ from standard arrow nocks in that, rather than having a deep slot (as for example, slot 25 of FIG. 1), the bowstring-contacting surface may be a shallow half-moon depression, a C-shaped recess, an angled recess, or the like. In some applications, the crossbow bolt end may even be substantially flat, i.e., perpendicular to the axis of the bolt. In all other respects, crossbow bolt ends function analogously to arrow nocks. One of ordinary skill in the art will readily appreciate that similar switching mechanisms and methods utilized for the lighted nock device as shown in FIGS. 1-11 may also be used for a lighted bolt end device.

Figure 12:
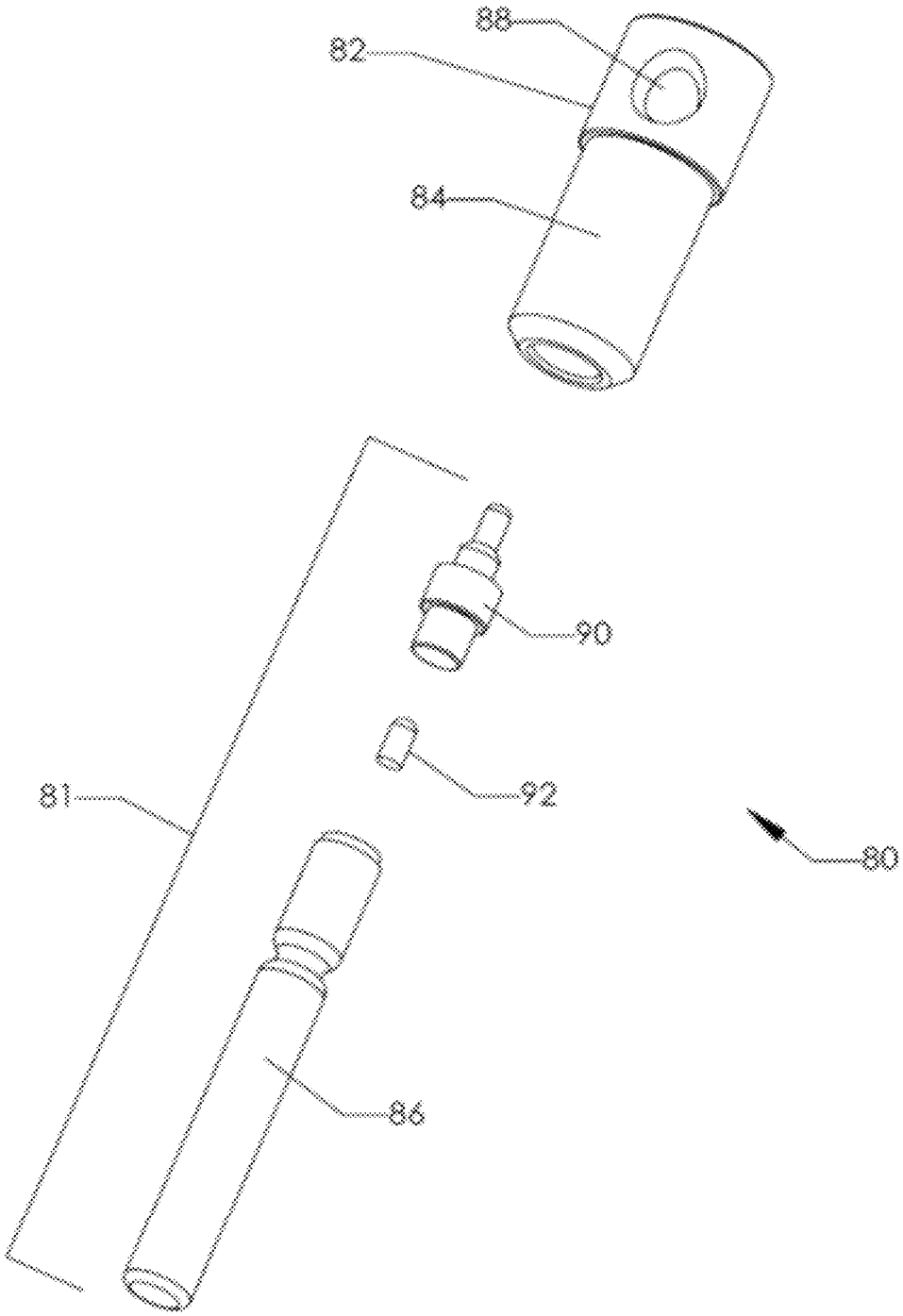
FIG. 12 is an exploded side perspective of a lighted bolt end device in accordance with some embodiments.

FIG. 12 depicts an exploded side perspective of a lighted bolt end device, according to one embodiment of the present invention. The lighted bolt end nock 80 comprises a bolt end body 82, a portion for attaching to a bolt 84, a reset aperture 88, and a light source assembly 81 comprising a power source 86, a slide switch 90, and a light source 92 such as (but without limitation) an LED. When fully assembled and in the open position (light source turned off), a portion of the switch 90 passes through an aperture (not visible) on the face of the bolt end body 82 opposite the portion for attaching to a bolt 84. When the crossbow bowstring is released, the force of the bowstring pushes on switch 90 forcing the switch into the closed position (light source turned on). The archer can now see the light emitted from the lighted bolt end device 80 allowing the archer to see the arrow during flight, see the point of arrow impact, and more easily find the arrow. The switch 90 may be maintained in the closed position (light source turned on) until the archer desires to turn it off. To turn off the lighted bolt end device, the archer may reach into the reset aperture 88 with a slender tool (as described above) and reverse the switch 90 until the switch contacts are open (light source turned off). The archer may now reuse the lighted bolt end device 80.

In one exemplary embodiment, the switch may comprise a slide switch disposed to slide toward bolt attachment portion when the crossbow bowstring is released, thereby closing the electrical circuit between the light source and the power source. One of ordinary skill in the art will appreciate that other types of switches, as noted above and without limitation, are equally useable in this application. Accordingly, embodiments of the invention adapted to use in a bolt end are not limited as to the type of switch employed.

In some embodiments of the lighted bolt end nock shown in FIG. 12, the lighted bolt end device does not comprise a reset aperture 88. In such an embodiment, the lighted bolt end cannot be turned off once it has been illuminated. The light source will remain illuminated until the power source is electrically drained. This could be useful for an inexpensive, disposable lighted bolt end nock.

In yet another alternate embodiment of the lighted bolt end nock shown in FIG. 12, the lighted bolt end nock may comprise two reset apertures 88. In this embodiment, the lighted bolt end nock can be turned off from either of the apertures and would have a reduced weight.

Figure 13:
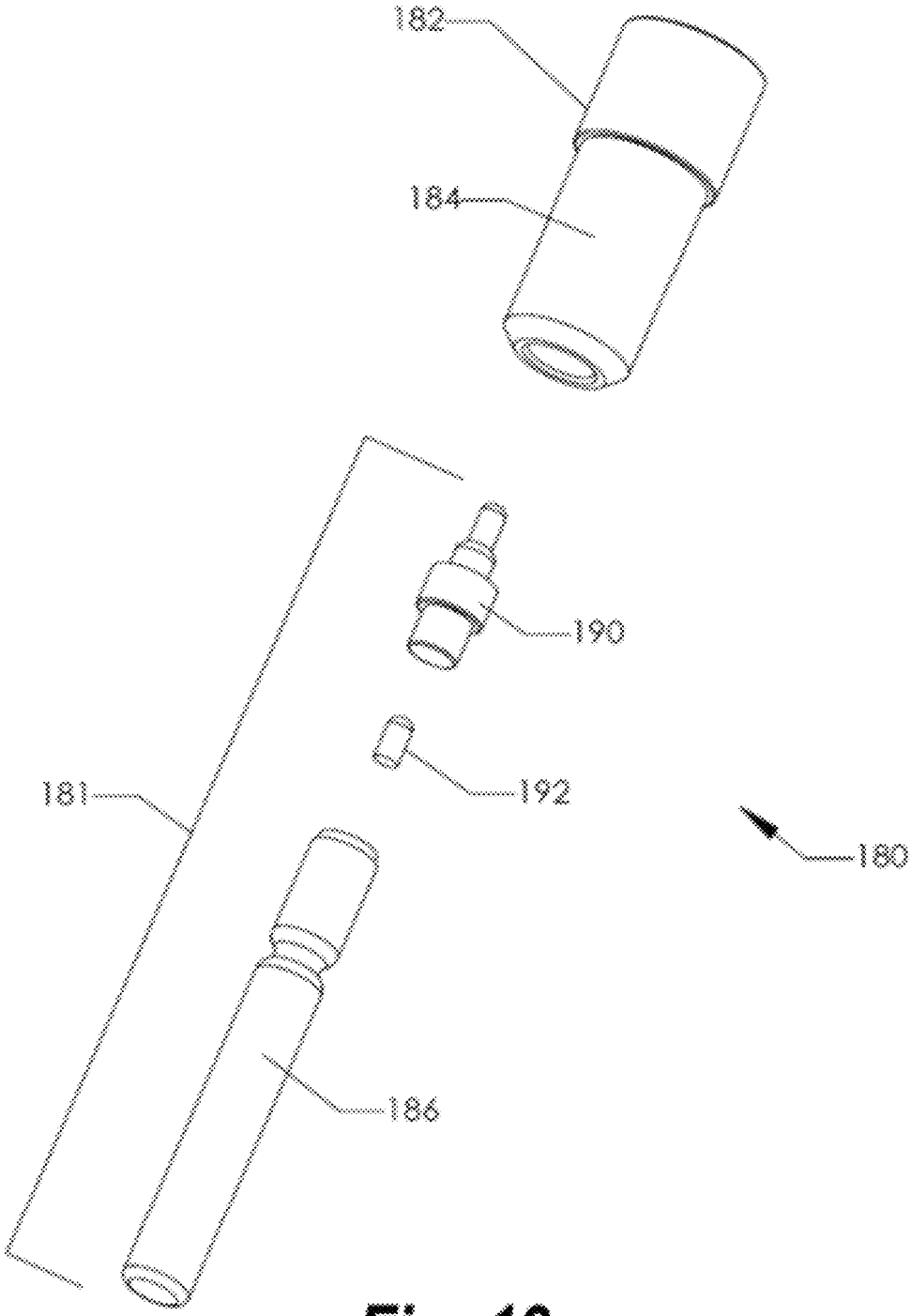
FIG. 13 is an exploded side perspective of a lighted bolt end device in accordance with some embodiments.

FIG. 13 is an exploded side perspective of a lighted bolt end device according to an alternate embodiment of the present invention. In this embodiment, a push on-push off switch is employed rather than the slide switch depicted in FIG. 12. As shown in FIG. 13, the lighted bolt end device 180 comprises a bolt end body 182, a portion for attaching to a bolt 184, and a light source assembly 181 comprising a power source 186, a push on-push off switch 190, and a light source 192. When fully assembled and in the open position (light source turned off), a portion of the switch 190 passes through an aperture (not visible) on the face of the bolt end body 182 opposite the portion for attaching to a bolt 184. When the crossbow bowstring is released, the force of the bowstring pushes on switch 190, temporarily depressing switch 190 into the bolt end and forcing the switch 190 into the closed position (light source turned on). The archer can now see the light emitted from the lighted bolt end device 180 allowing the archer to see the bolt during flight, see the point of bolt impact, and easily find the bolt. As the lighted bolt device 180 leaves the crossbow bowstring, a portion of the switch 190 returns from the aperture of the bolt end body 182 and the light source remains on until the archer desires to turn it off. To turn off the lighted bolt end device, the archer pushes the switch 190 again to open the switch contacts and turn the light source off. The archer may now reuse the lighted bolt end device 180.

In an alternate embodiment of the lighted bolt end device illustrated in FIG. 13, the lighted bolt end device may comprise an electronically-maintained (or electronic) switch as an alternative to a mechanically-maintained/mechanical switch. In such a device, the bowstring would make contact with a momentary type switch configured to send a signal to an electrical circuit configured to receive the input and to toggle the light source on and off. The electronic switch may further comprise a piezoelectric element that generates an electrical impulse that is sent to the electronic circuit configured to receive the input to toggle the light source on and off In such an embodiment, a reset aperture is not required to turn the light source off.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

The benefits and advantages that may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions, and improvements to the embodiments described above are possible. It is contemplated that these variations, modifications, additions, and improvements fall within the scope of the invention as detailed within the following claims.

I claim:

1. A lighted nock comprising:

a nock body comprising an arrow attachment portion and a proximate end having a first arcuately shaped portion and a corresponding second arcuately shaped portion adapted to receive a bowstring, and a third arcuately shaped portion and a corresponding fourth arcuately shaped portion adapted to receive the bowstring after the bowstring is released from a drawn position; and a light source assembly at least partially disposed within the nock body and activated when the bowstring is released from the drawn position;

wherein the light source assembly comprises a power source, a light source, and a switch;

wherein the light source is not activated prior to the third and fourth arcuately shaped portions receiving the bowstring, and wherein the light source is activated when the third and fourth arcuately shaped portions receive the bowstring; and wherein at least a portion of the light source assembly protrudes into the proximate end.

2. The lighted nock of claim 1, wherein the switch is mechanically latched or electronically latched.

3. The lighted nock of claim 1, wherein the nock body further comprises one or more reset apertures disposed to reset the switch.

4. The lighted nock of claim 1, wherein the lighted nock weighs less than 30 grains.

5. A lighted nock comprising:

nock body comprising an arrow attachment portion and a proximate end having a first arcuately shaped portion and a corresponding second arcuately shaped portion adapted to receive a bowstring and a third arcuately shaped portion and a corresponding fourth arcuately shaped portion adapted to receive the bowstring after the bowstring is released from a drawn position;

a push rod at least partially disposed within the nock body, wherein at least a portion of the push rod protrudes into the proximate end; and a light source assembly at least partially disposed within the nock body; wherein the light source assembly comprises a power source, a light source, and a switch; and wherein the light source assembly is activated when the push rod pushes the light source toward the power source when the bowstring is released from the drawn position; and wherein the light source is not activated prior to the third and fourth arcuately shaped portions receiving the bowstring, and wherein the light source is activated when the third and fourth arcuately shaped portions receive the bowstring.

6. The lighted nock of claim 5, wherein the switch is mechanically latched or electronically latched.

7. The lighted nock of claim 5, wherein the nock body further comprises one or more reset apertures disposed to reset the switch.

8. The lighted nock of claim 5, wherein the lighted nock weighs less than 30 grains.

9. A lighted nock comprising:

a nock body comprising an arrow attachment portion and a proximate end having a first arcuately shaped portion and a corresponding second arcuately shaped portion adapted to receive a bowstring in a drawn position, and a third arcuately shaped portion and a corresponding fourth arcuately shaped portion adapted to receive the bowstring after the bowstring is released from the drawn position; and a light source assembly at least partially disposed within the nock body and activated when the bowstring is released from the drawn position;

wherein the light source assembly comprises a power source, a light source, and a switch; wherein at least a portion of the light source assembly protrudes into the proximate end; and wherein the bowstring moves toward the light source assembly to activate the light source assembly after the bowstring is released from the drawn position.

10. The lighted nock of claim 9, wherein the switch is mechanically latched or electronically latched.

11. The lighted nock of claim 9, wherein the nock body further comprises one or more reset apertures disposed to reset the switch.

12. The lighted nock of claim 9, wherein the light source assembly further comprises a push rod wherein a portion of the push rod protrudes into the proximate end.

13. A lighted bolt end comprising:

a bolt end body comprising a proximate end adapted to receive a bowstring thereon and a bolt attachment portion, the proximate end having a first arcuately shaped portion and a corresponding second arcuately shaped portion adapted to receive a bowstring, and a third arcuately shaped portion and a corresponding fourth arcuately shaped portion adapted to receive the bowstring after the bowstring is released from a drawn position; and a light source assembly at least partially disposed within the bolt end body and activated when the bowstring is released from the drawn position;

wherein the light source assembly comprises a power source, a light source, and a switch; and wherein at least a portion of the light source assembly protrudes from the proximate end.

14. The lighted bolt end of claim 13, wherein the switch is mechanically latched or electronically latched.

15. The lighted bolt end of claim 13, wherein the bolt end body further comprises one or more reset apertures disposed to reset the switch.

16. The lighted bolt end of claim 13, wherein the light source comprises a light emitting diode.

17. A method for illuminating a nock, comprising:

providing a nock having: a nock body comprising an arrow attachment portion and a proximate end having a first arcuately shaped portion and a corresponding second arcuately shaped portion adapted to receive a bowstring and a third arcuately shaped portion and a corresponding fourth arcuately shaped portion adapted to receive the bowstring alter the bowstring is released from a drawn position; and a light source assembly at least partially disposed within the nock body and activated when the bowstring is released from the drawn position;

wherein the light source assembly comprises a power source, a light source, and a switch; and wherein at least a portion of the light source assembly protrudes into the proximate end; drawing the bowstring; and releasing the bowstring, thereby contacting the protruding portion of the light source assembly and illuminating the nock.

18. The method of claim 17, wherein the switch is mechanically latched or electronically latched.

19. The method of claim 17, wherein the nock body further comprises one or more reset apertures for resetting the switch.

20. A method for illuminating a bolt end, comprising:

providing a bolt end having:

a bolt end body comprising i) a proximate end having a first arcuately shaped portion and a corresponding second arcuately shaped portion adapted to receive a bowstring thereon, ii) a third arcuately shaped portion and a corresponding fourth arcuately shaped portion adapted to receive the bowstring after the bowstring is released from a drawn position, iii) and a bolt attachment portion; and a light source assembly at least partially disposed within the bolt end body and activated when the bowstring is released from a drawn position;

wherein the light source assembly comprises a power source, a light source, and a switch; and wherein at least a portion of the light source assembly protrudes from the proximate end;

drawing the bowstring; and releasing the bowstring, thereby contacting the protruding portion of the light source assembly and illuminating the bolt end.

21. The method of claim 20, wherein the switch is mechanically latched or electronically latched.

22. The method of claim 20, wherein the bolt end body further comprises one or more reset apertures for resetting the switch.

23. A lighted nock comprising:

a nock body comprising an arrow attachment portion and a proximate end having a first portion adapted to receive a bowstring and a second portion adapted to receive the bowstring after the bowstring is released from a drawn position;

a push rod at least partially disposed within the nock body, wherein at least a portion of the push rod protrudes into the proximate end;

a light source assembly at least partially disposed within the nock body; wherein the light source assembly comprises a power source, a light source, and a switch; and wherein the light source assembly is activated when the push rod pushes the light source toward the power source when the bowstring is released from the drawn position; and wherein the nock body further comprises one or more reset apertures disposed to reset the switch.

* * * * *